US006073786A

United States Patent [19]

McCorkle, Jr.

[11] Patent Number: 6,073,786

[45] Date of Patent: Jun. 13, 2000

[54] DISPLAY RACK WITH SHELVES

[75] Inventor: Donald E. McCorkle, Jr., Dearing, Ga.

[73] Assignee: McStack USA, Marietta, Ga.

[21] Appl. No.: 09/116,508

[22] Filed: Jul. 16, 1998

Related U.S. Application Data

[63] Continuation-in-part of application No. 08/608,083, Feb. 28, 1996, abandoned.

[51] Int. Cl.[7] ..... A47B 43/00

[52] U.S. Cl. ..... 211/187; 211/181.1

[58] Field of Search ..... 211/187, 153, 211/181.1, 182, 191, 194, 195; 108/107, 137, 180, 192, 193

[56] References Cited

U.S. PATENT DOCUMENTS

| | | | |
|---|---|---|---|
| 3,007,708 | 11/1961 | Ochs . | |
| 3,268,089 | 8/1966 | Hall | 211/153 |
| 3,536,016 | 10/1970 | Chesley | 108/181 |
| 3,915,097 | 10/1975 | Young, Jr. | 108/6 |
| 3,986,462 | 10/1976 | Heft | 211/153 X |
| 4,157,070 | 6/1979 | Huempfner et al. | 108/107 X |
| 4,231,301 | 11/1980 | Barrineau, III | 211/153 X |
| 4,292,902 | 10/1981 | Barrineau | 108/146 |
| 4,391,378 | 7/1983 | Secon | 211/187 |
| 4,558,647 | 12/1985 | Petersen | 211/181 X |
| 5,094,350 | 3/1992 | Smock | 211/59.2 |
| 5,160,052 | 11/1992 | Wudka | 211/90 |
| 5,233,931 | 8/1993 | McCorkle, Jr. | 108/55.1 |
| 5,295,446 | 3/1994 | Schafer | 108/167 |
| 5,408,939 | 4/1995 | Lechman | 108/107 |

FOREIGN PATENT DOCUMENTS

| | | | |
|---|---|---|---|
| 8601 393 | 12/1987 | Netherlands | 211/153 |

*Primary Examiner*—Alvin Chin-Shue
*Assistant Examiner*—Sarah Purol
*Attorney, Agent, or Firm*—Clark & Brody

[57] ABSTRACT

The present invention relates to a merchandise rack that can be used to store, transport and display merchandise without ever having to remove the merchandise until the consumer does. The invention comprises a base unit and upright end sections extending therefrom for supporting multiple shelves therebetween, wherein multiple support elements are provided on each of the end sections to vary the level and angle at which the shelves are supported. More than one shelf can be provided per level and tilted in opposite directions to provide better visibility and accessibility during display. The base unit and end sections are also modular so that the frame can be stacked either with or without the end sections and shelves attached.

11 Claims, 7 Drawing Sheets

DISPLAY RACK WITH SHELVES

RELATED APPLICATIONS

This application is a continuation-in-part of U.S. application Ser. No. 08/608,083, now abandoned which was filed on Feb. 28, 1996.

FIELD OF INVENTION

This invention relates to the field of merchandise racks, and in particular, to a rack system that can be used to store, transport and display merchandise.

BACKGROUND OF THE INVENTION

Plants and flowers are often sold in individual pots at retail stores, showrooms, and the like, and are typically displayed in both indoor and outdoor areas. The nature of plants and flowers requires them to be placed in pots so that they can continue to be watered and receive sunlight during transport and display. It is also important for consumers to view and access the plants and flowers easily so that they can determine which to purchase and then carry them to the cashier.

An inherent problem in the prior art with selling plants and flowers in individual pots in this manner, however, is that each pot must be handled several times before it reaches the display site. That is, each pot must typically be handled one-by-one from location to location, thereby increasing cost and making transport time-consuming and inconvenient. Another problem with selling plants and flowers in this manner is that they cannot be packaged and stacked like other merchandise, and therefore, special shelves are needed both for transporting and displaying the pots.

In my previous invention, as shown in U.S. Pat. No. 5,233,931, a rack can be used to transport potted plants and flowers and to display them without the necessity of removing the plants and flowers from the rack. The rack comprises stacking shelves with a front, hinged portion which, in its upright position, maintains the pots on the shelves during transport and in its lowered position provides an extended area for display. Each shelf has built-in comer supports with posts that may be of different lengths to set the vertical distance between adjacent shelves. When the distance between shelves is large, that invention is particularly useful for displaying taller plants and flowers.

SUMMARY OF THE INVENTION

The present invention is a merchandise rack that is able to store, transport and display merchandise, such as potted plants and flowers, without removing the merchandise from the rack. It represents an improvement over previous devices because the position and angle of the shelves is more adjustable, and the available space can be used with greater efficiency. The present invention is characterized by a support frame having a base unit and two removable, upright end sections, wherein multiple removable shelves can be supported on the support frame between the end sections. The shelves can be easily positioned on the frame, either substantially horizontally between the end sections, or tilted to the side for better visibility and accessibility of the plants during display. Each end section is preferably provided with two support posts and multiple support elements extending substantially horizontally between the support posts. The multiple support elements are preferably either angle irons or bar-like members that extend parallel to one another with a predetermined vertical separation between vertically adjacent ones. By providing a multiple number of support elements on each of the end sections, the number of shelves and the vertical distance between adjacent ones are easily adjusted.

Preferably, the shelves are adapted in size so that more than one shelf can be placed side-by-side at any one level. In this respect, the shelves are preferably about half the width of the end sections such that two similar shelves can be placed across the frame side-by-side between the end sections. The shelves can also be tilted in opposite directions to increase visibility and accessibility to the plants from both sides of the device. In addition, the shelves can be provided with a stop for preventing excess upward movement of the shelves during transport.

The frame can also be stacked on other, similar frames. The base unit has footings that support the device on the ground and also mate with the support posts of an adjacent lower frame so that multiple frames can be stacked on each other. Each end section preferably has two support posts that extend upward from each of the comers of the base unit, and each of the footings is also positioned at the comers.

The end sections can also be removed from the base unit so that when the base units are not in use they can be easily stacked. The end sections are secured to the base by any of several types of connecting members that extend from the base unit to allow the support posts and, therefore, the end sections to be removed from the base unit when desired. The connecting members are designed to mate with and connect to the footings of an adjacent base unit so that multiple base units can be stacked on top of each other. This makes the base units easy to handle, transport and store.

The base units also have brackets that can be engaged by fork lift tines so that heavy merchandise can be easily lifted with the frame. Special tine-conforming brackets are preferably placed on the bottom of the base units so that fork lift tines can be inserted therein and used to lift the rack when the shelves are fully loaded.

DETAILED DESCRIPTION OF THE INVENTION

Figure 1:
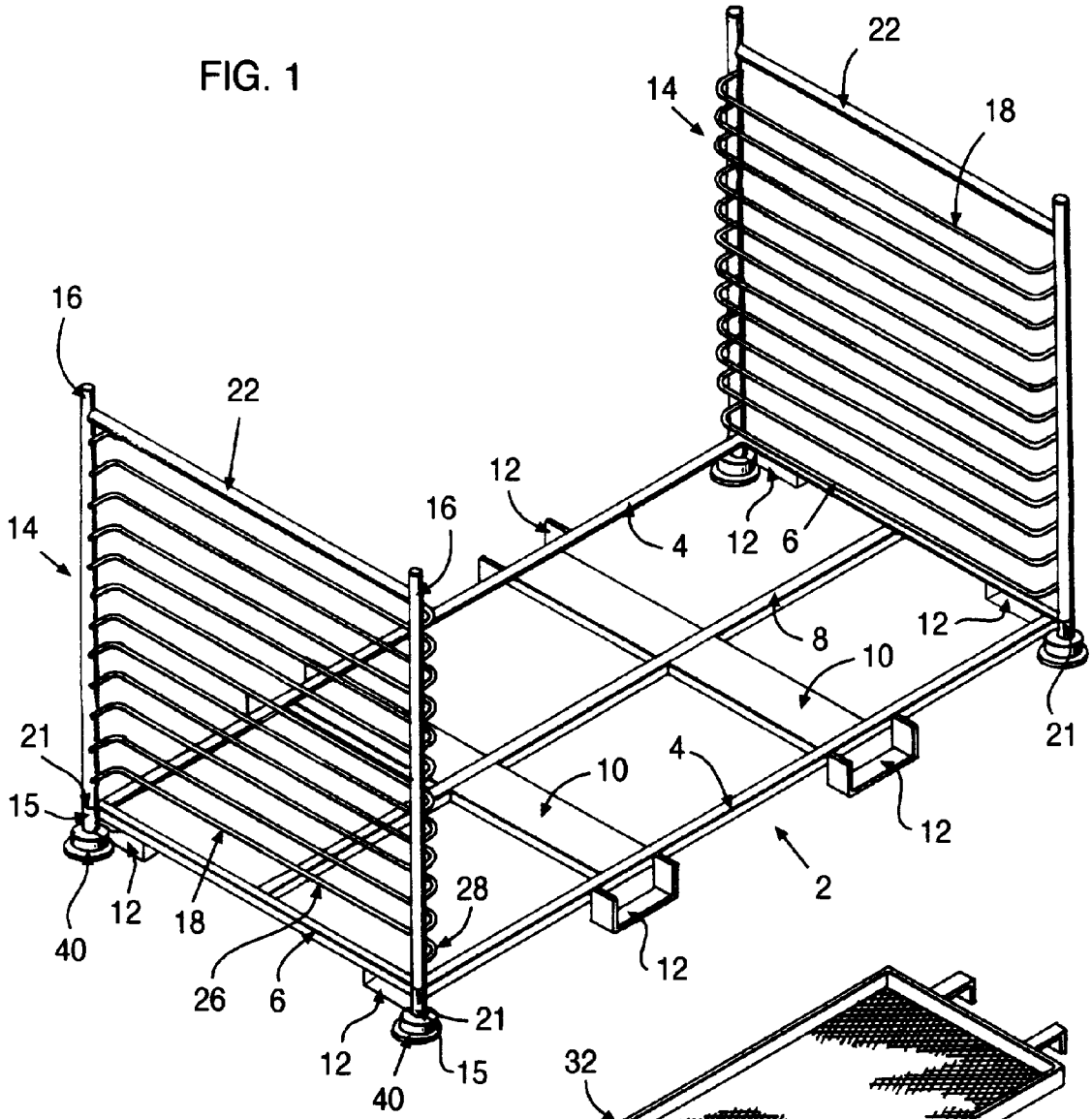
FIG. 1 is a perspective view of the base unit and end sections of one embodiment of the present invention.
Figure 2:
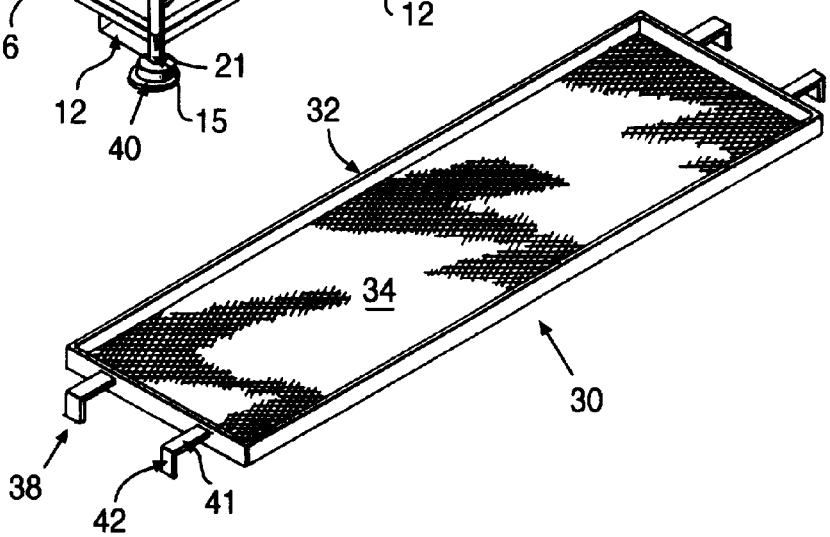
FIG. 2 is a perspective view of a shelf member of one embodiment of the present invention.

As seen in FIG. 1, the present invention comprises a substantially rigid frame generally having a base unit 2 that extends substantially horizontally across the bottom thereof, and two substantially upright end sections 14 extending upwardly from either end of the base unit. The frame is substantially configured with the upright end sections 14 extending upward from either end of the base unit such that multiple shelf members 30, as seen in FIG. 2, can be positioned on the frame between the end sections 14.

The base unit 2 is preferably rectangular (or square) in configuration in plan, although not necessarily so. In the embodiment shown in FIG. 1, for example, the base unit 2 is rectangular with the end sections 14 extending upwardly from the short ends, and the shelf members 30 are adapted to extend between the end sections in the long direction. In the preferred embodiment, the base unit 2 is made of a strong, substantially rigid material, such as steel, plastic, wood or composite material, etc. The base unit of the present invention shown in the drawings is preferably formed out of solid or hollow beam-like members, although the base unit can also be made from a single continuous member forming a bottom shelf or floor if desired.

In the embodiment shown in FIG. 1, the base unit 2 is comprised of side beams 4 on either side of the base unit 2 and end beams 6 extending on either end of the base unit. Spanning between the side and end beams are a center beam 8 extending between the centers of the end beams 6 and two support beams 10 extending between the side beams 4. Brackets 12 extend from the underside of the side beams 4 which are configured to receive forklift tines to enable the display rack to be moved by a forklift. The support beams 10 which extend between the side beams 4 are preferably wide enough such that they lend support to and engage the forklift tines when the device is lifted. Additional brackets 12 are also provided on the end beams 6, as shown in FIG. 1, such that the device can be lifted by a forklift from the ends as well. The brackets 12 are preferably spaced an appropriate distance to accommodate the tine spacing of a standard forklift.

At each comer of the base unit 2 there is preferably a leg 15 made of a tube-like member, which is attached at the intersection of the side beams 4 and end beams 6. The legs 15 may be hollow or have a cavity therein to receive connecting elements 20, shown in FIG. 3, or rods onto which the support posts 16 of the end sections 14 can be removably secured. Each of the connecting elements 20 extends into the leg 15 and upwardly therefrom above the base unit in the manner of a small post.

Connected to the bottom of each of the legs 15 is a footing 40 for supporting the base unit 2 in relation to the ground. Each of the footings 40 is relatively wide on the bottom in substantially a bell-shape to provide good ground support for the base unit 2. By having four footings, one on each comer of the base unit, the frame can be fully supported. Each footing also has a cavity or hollowed-out area on the bottom thereof into which the upper end of a support post 16 or connecting element 20, as the case may be, can be inserted for stacking, as will be discussed.

Figure 3:
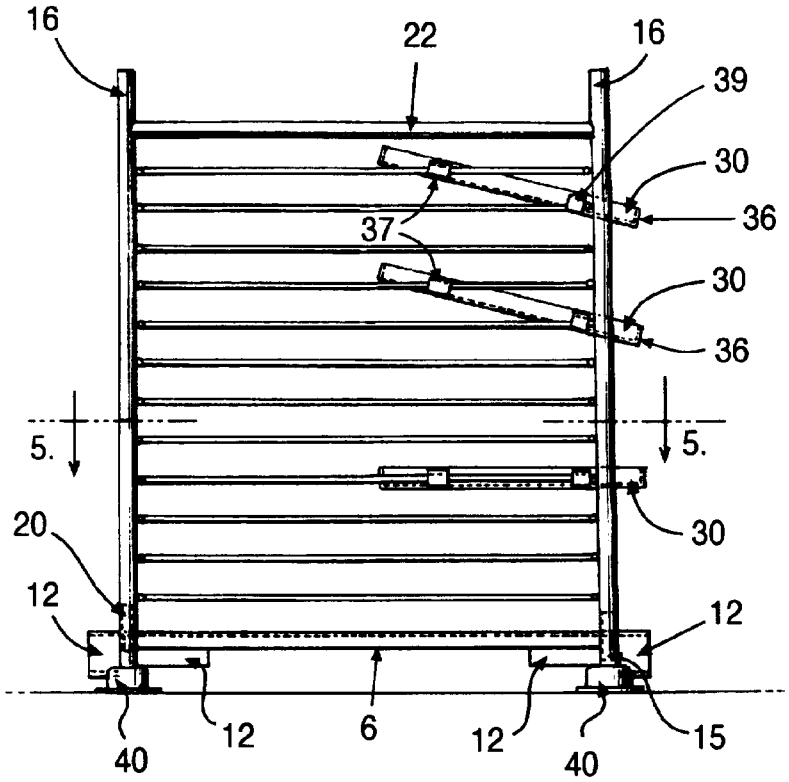
FIG. 3 is an end view of the embodiment of FIG. 1 showing one shelf member horizontal and two shelf members tilted.

Removably mounted to the base unit 2 are the end sections 14. Two upright support posts 16 of each end section 14 are removably secured to the base unit 2 via the connecting elements 20, which in the embodiment shown in FIG. 3, is a rod extending into the leg 15 and upward therefrom. The support posts 16 may be hollow, or have a cavity therein, so that they can be positioned over the outside of the associated connecting rods extending upward from the base unit 2. The bottoms of the support posts 16 meet the legs 15 along line 21 as shown in FIG. 1. Each connecting rod 20 (see FIG. 3) is preferably removable from the base unit 2 so that multiple base units can be shipped flat prior to assembly.

On each of the end sections 14 multiple elongated support members 18 are provided which preferably extend substantially horizontally and parallel to each other between its two support posts 16. Each of the support members 18 includes vertical and horizontal elements provided by an angle iron with a cap at each end or a rod-like member having a relatively small diameter. In the embodiment shown in FIG. 1, the support members 18 are spaced vertically from each other by equal distances, i.e., for example, by about four inches. In the rod-like version, each support member 18 preferably has two inwardly oriented portions 28 extending inward from each of the two support posts 16. An elongated portion 26 extends substantially horizontally between the two inward oriented portions 28 on each support member. The inward orientation of the portions 28 positions the elongated portions 26 of the support members 18 inwardly of the opposing end sections 14. This enables the shelf members 30 to be easily placed on top of opposing support members 18.

Figure 10:
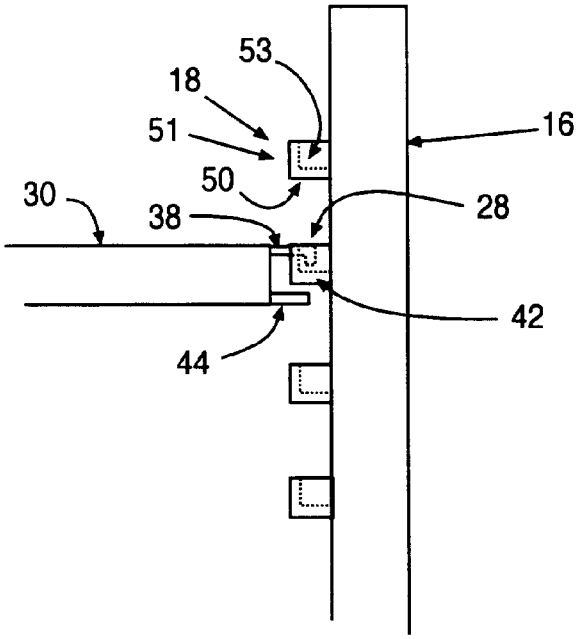
FIG. 10 is a side view of the present invention showing the shelf member shown in FIG. 9 positioned on the support frame.
Figure 11:
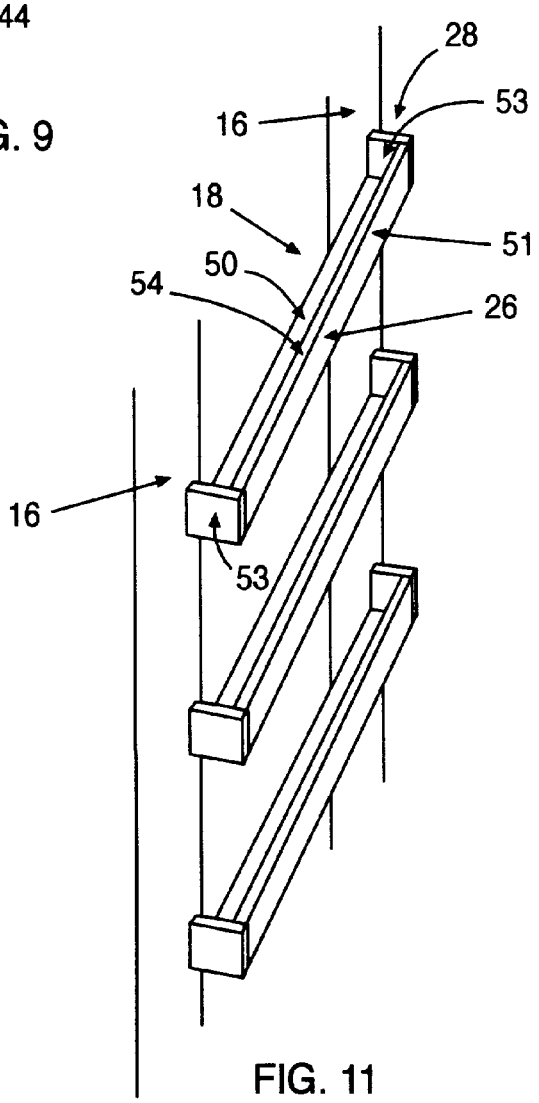
FIG. 11 is a perspective view of a second embodiment of the horizontal support elements.

In the angle iron version, the support members 18, as shown in FIGS. 10 and 11, include flange 50 along the bottom and the other flange 51 on the side away from the support posts 16. An end cap 53 is provided at each end to mount the angle iron rigidly on the support post. The end cap 53 can be separately formed and attached or it can also be a bent portion of either flange 50 or 51. Together, the upper edge of the vertical flange 51 and end caps 53 form a substantially continuous edge 54 which is substantially similar to the combination of the elongated portion 26 connected to the two inwardly oriented portions 28, i.e., the vertical flange 51 functions as elongated portion 26 and the end caps 53 function as the inwardly oriented portions 28.

In the embodiment shown in FIG. 1, on each end section 14, spanning between the upper ends of the support posts 16, is an additional brace 22 which helps to provide rigidity to the end sections 14. This brace 22 is not necessary, however, if the base unit 2 and end sections 14 are sufficiently rigidly connected to each other, as will be discussed.

As seen in FIG. 2, the support shelf 30 preferably comprises a substantially rectangular, flat member for supporting objects thereon. In this embodiment, the shelf 30 has a flat portion 34 which can be a continuous surface or a mesh or other structure if desired to support merchandise while preferably allowing water to drain. The shelf member 30 can be made of any substantially strong and rigid material and is preferably made of the same material as is the base unit 2 and end sections 14. Preferably extending around the edge of the shelf member 30 are walls 32 which help to maintain objects on the shelf when the shelf member is tilted. In this embodiment, the walls 32, are formed of angle iron to form a frame around the edge, which contains the contents of the shelf during shipment and when tilted.

Extending outward from the far ends of each shelf member 30 are two attachment members 38 for engaging the support members 18 and supporting the shelf member 30 on and between the end sections 14. Each of the attachment members 38 preferably has as an outwardly extended portion 41 for resting on the support members 18 and a downwardly extended portion 42 at the distal end thereof. The downwardly extended portion 42 enables the shelf members 30 to be properly supported on the support members 18 without sliding off, as will be discussed.

Figure 4:
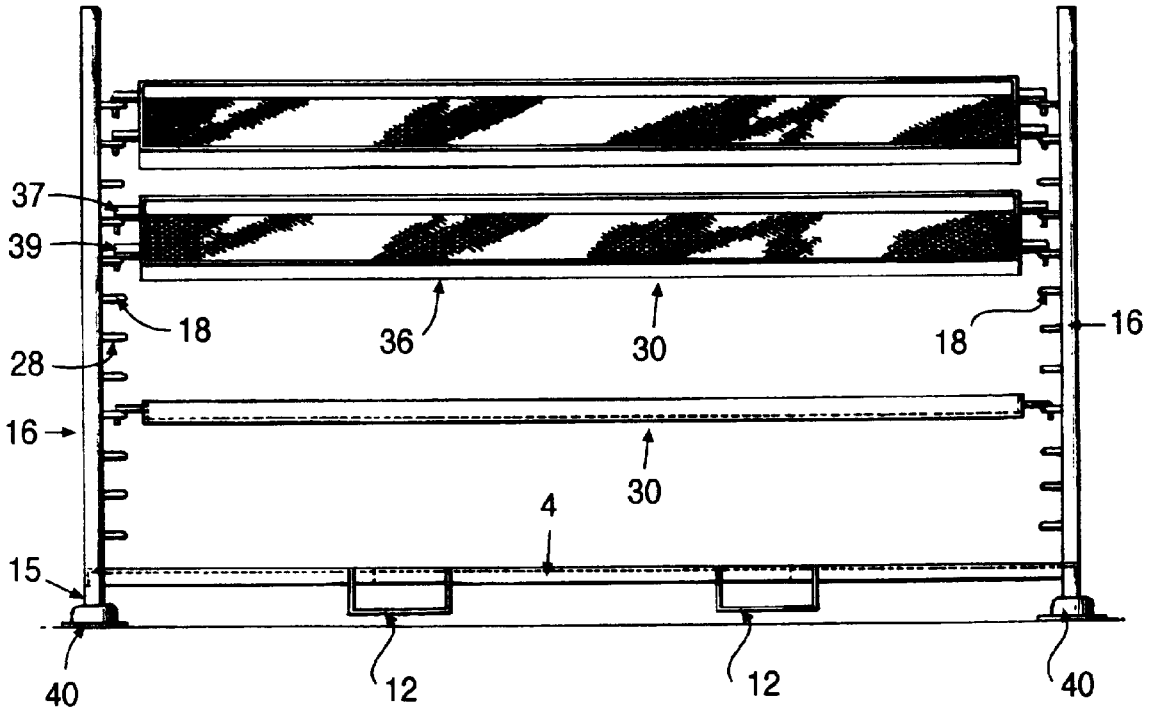
FIG. 4 is a side view of the embodiment as shown in FIG. 3.

Because the length of shelf member 30, as shown in FIG. 4, is less than the distance between opposing support members 18 on opposing end sections 14, the attachment members 38 preferably extend far enough in relation to the ends of the shelf members 30 such that they engage the associated support members 18 to provide sufficient support for the shelf members. Each shelf member 30 can be pulled outward (or forward) in relation to the support posts 16, as will be discussed, to change the vertical position and/or angle of the shelf members 30 in relation to the end sections 14.

FIG. 3 shows an end view of the present invention with a base unit 2 and end section 14 attached extending upwardly therefrom. FIG. 3 shows how the shelf members 30 can be positioned either horizontally between the end sections, or tilted in a direction transverse to the long direction. The horizontal orientation is generally used when the merchandise is being transported, and the tilted orientation is generally used to display the merchandise. In the horizontal position, the attachment members 38 on each respective end of the shelf member 30 are positioned on a single support member 18. In the tilted position, the front attachment members 39 are positioned on support members 18 at one level, and the back attachment members 37 are positioned on support members 18 at another level. For example, in the embodiment shown in FIG. 3, the two top shelf members are tilted with the back attachment members 37 on the relatively high support members 18 and the front attachment members 39 on the adjacent lower support members 18. When the shelf members are tilted in this manner, the downwardly extended portions 42 of the front attachment members 39 engage the inwardly oriented portions 28 or end caps 53 of the support members 18 such that the shelf members 30 are prevented from sliding off of the support members 18.

Figure 5:
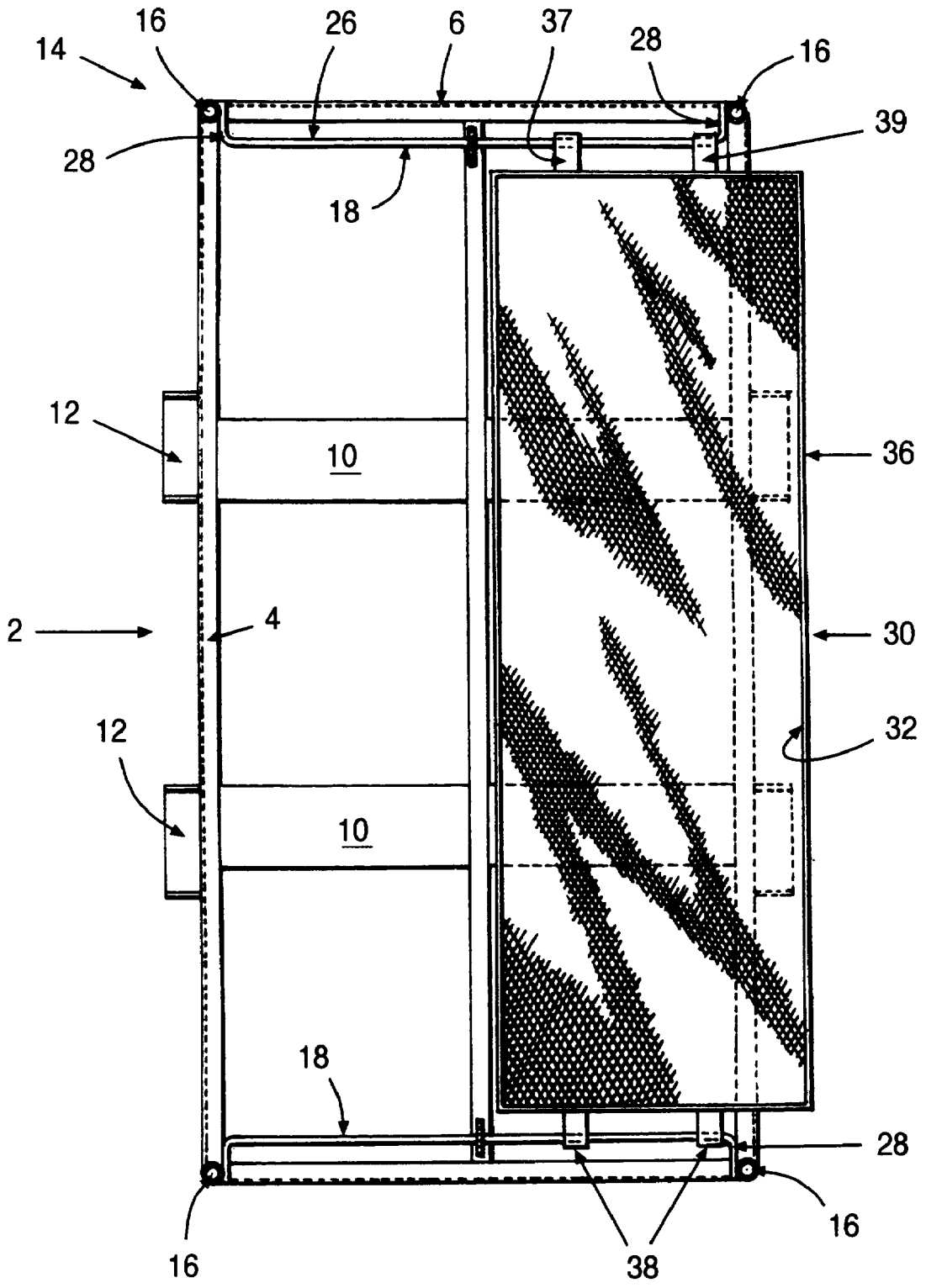
FIG. 5 is a top view of the embodiment of FIG. 3.

As seen in FIGS. 3 and 5, the position of the attachment members 38 in relation to the shelf member 30 can determine the extent to which the shelf member 30 can be extended outward or forward from the vertical plane formed by the front edge of the support posts 16. That is, when the downwardly extended portions 42 of the front attachment members 39 engage the inwardly oriented portions 28 or end caps 53 of the support members 18 to prevent the shelf members from sliding outward in relation to the end sections 14, the distance between the inward oriented portion 28 or end cap 53 of the support member 18 and the forward-most edge of the support post 16 is preferably less than the distance between the front attachment member 39 and the front edge 36 of the shelf member 30. In the preferred embodiment, the front edge 36 does not extend beyond the vertical plane of the support posts 16, even when tilted.

Figure 6:
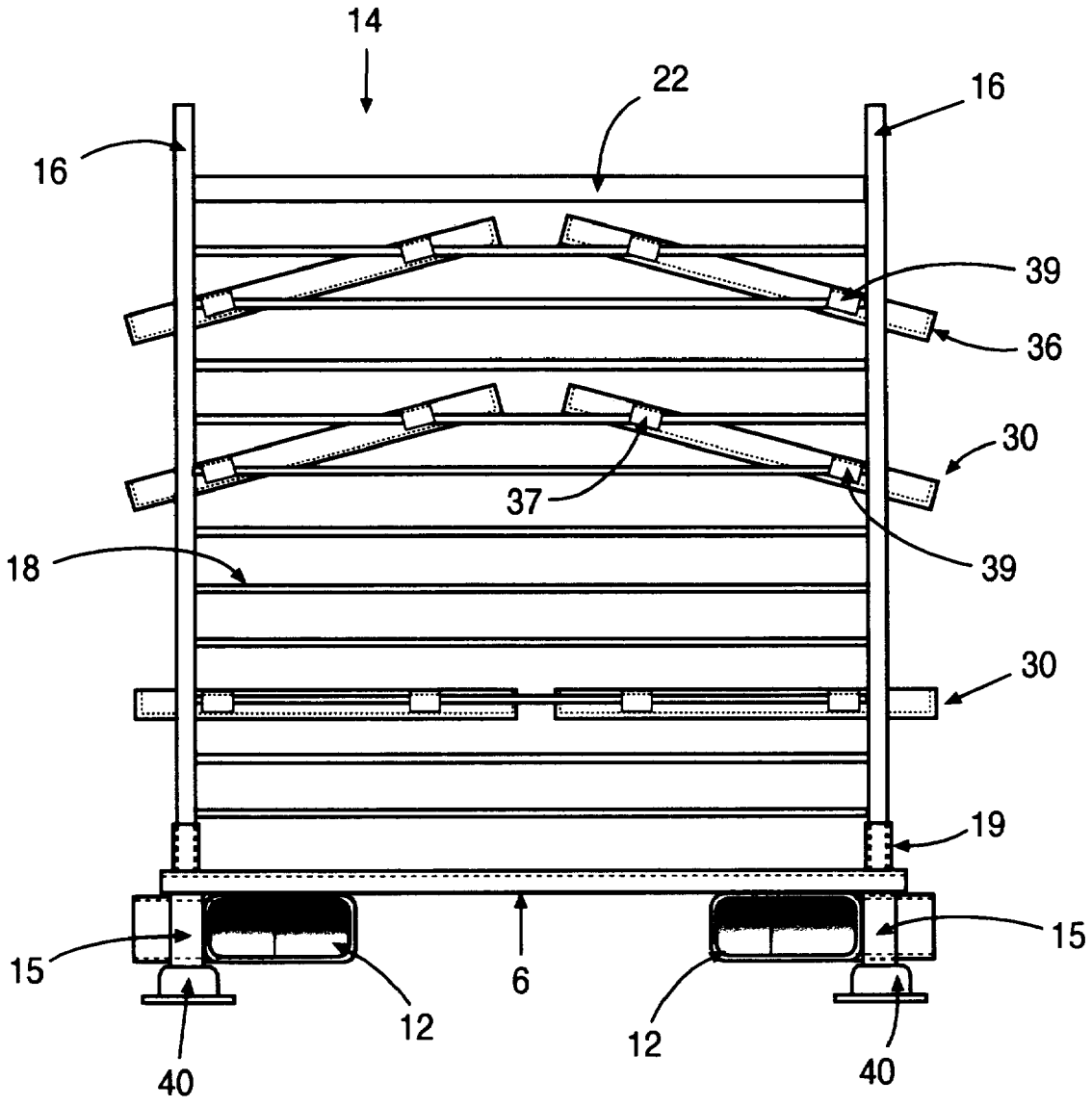
FIG. 6 is an end view of a second embodiment of the present invention having modified connecting members for connecting the base unit to the end sections and wherein side-by-side shelf members are illustrated.

More than one shelf can be positioned at each level as shown in FIG. 6. In the embodiment shown, the shelf members are appropriately sized and adapted such that they can be positioned side-by-side between the end sections 14 at each level. And, to enhance visibility and accessibility during display, shelf members 30 on the same level can be tilted in opposite directions such that the front edge 36 of one shelf member faces the opposite direction from the front edge 36 of the other shelf member. The width of the shelf members 30 is preferably less than half the width of the end sections 14 to enable at least two shelf members 30 to be positioned side-by-side on the same level, while allowing the front edges 36 to extend beyond the vertical plane of the support posts, as previously discussed.

In the embodiment of FIG. 6, the elements connecting the end units to the base, which are rods 20 in the embodiment of FIG. 3, are tube-like members 19 rigidly attached to and extending upwardly from each corner of the base unit 2. In this embodiment, the support posts 16 are removably secured to the base unit 2 by sliding the support posts inside the tube-like members 19 rather than outside. There is preferably a snug fit between the support posts 16 and tube-like members 19 to provide sufficient rigidity between the base unit 2 and end sections 14 such that additional bracing, such as brace 22, is not needed.

In this embodiment, the hollowed areas or cavities on the bottom of the footings 40 are preferably large enough to not only mate with the upper ends of the support posts 16 of adjacent substantially identical frames, but also large enough to mate with the tube-like members 19 extending from the base unit. In this manner, not only can substantially identical frames with the end sections 14 attached be stacked on top of each other, as shown in FIG. 7, but substantially identical base units without the end sections 14 attached can also be stacked on top of each other for easy handling and storage, as shown in FIG. 8.

Figure 7:
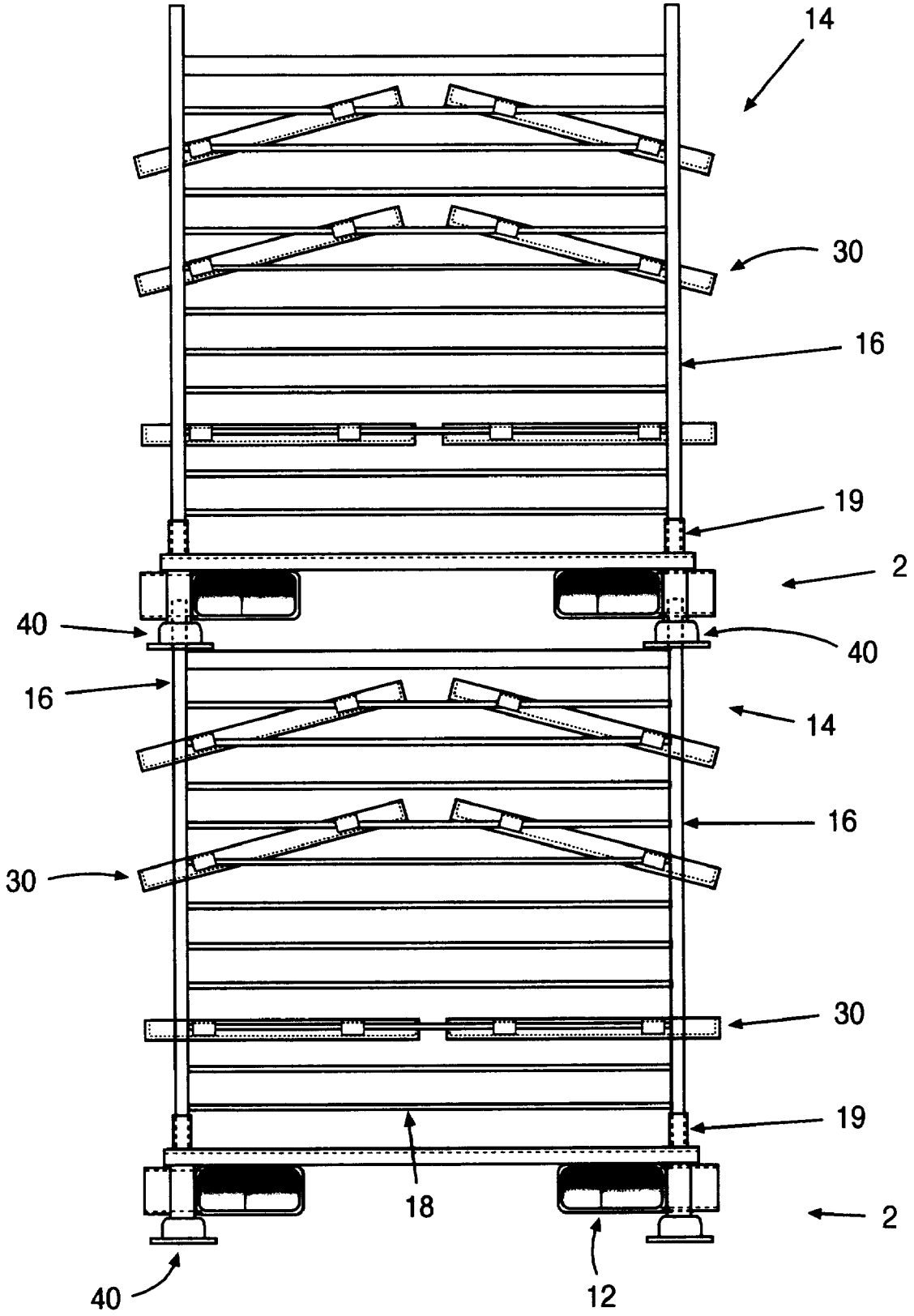
FIG. 7 is an end view of two units of the second embodiment of the present invention stacked together with the end sections and shelves attached.

FIG. 7 shows an end view of two frames stacked on top of each other as discussed. The top frame is simply placed over the bottom frame, placing the footings 40 on top of the upper ends of the support posts 16 of the bottom frame. A number of frames can be stacked in this manner. Even with the shelf members fully loaded, a forklift can be used to lift the frames using the forklift brackets 12.

Figure 8:
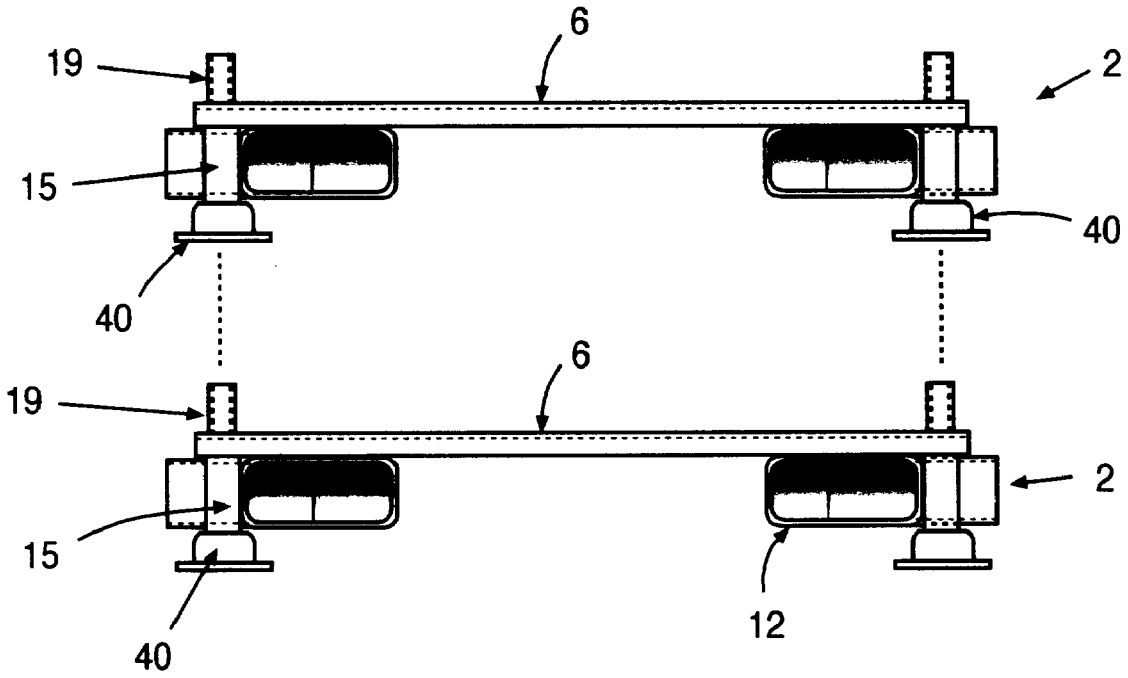
FIG. 8 is an exploded view of two base units of the second embodiment of the present invention, which can be stacked on top of each other when the end sections are not attached.

FIG. 8 shows an exploded view of two base units without the end sections 14 attached so that they can be stacked on top of each other. The end sections 14 can be removed from the base unit 2 by pulling the support posts 16 from the connecting rods 20, shown in FIG. 1, or tube-like members 19, shown in FIG. 6. Then, one base unit is simply placed over another base unit, placing the footings 40 of the top base unit on top of the upper ends of the rods 20 or tube-like members 19 of the bottom base unit, enabling multiple base units to be stacked on top of each other.

Figure 9:
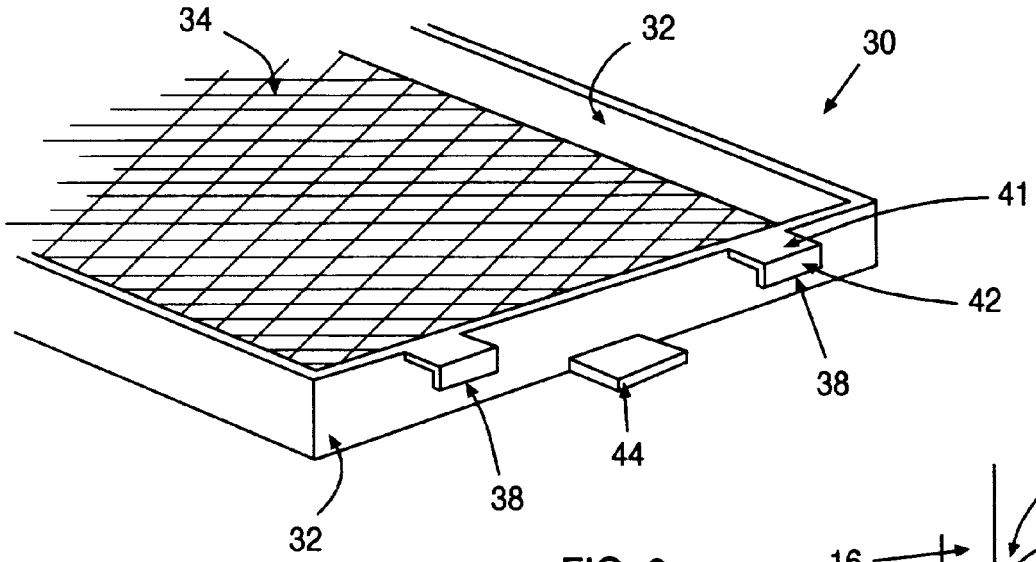
FIG. 9 is a perspective view of an end of a shelf member of the present invention showing two attachment members and one tab member between them.

As shown in FIG. 9, each end of the shelf members 30 can be adapted to have an additional tab-like member 44, which preferably extends outward from the wall 32 of the shelf member 30 between the two attachment members 38. While the attachment members 38 in this embodiment preferably extend from the upper part of the wall 32, the tab-like member preferably extends from the lower part of the wall 32. In this manner, when the shelf members are supported by the end sections 14, the attachment members 38 can be positioned above the support members 18, as shown in FIG. 10, and the tab-like members 44 can be positioned below (without touching) the support members 18. In this manner the tab-like members 44 prevent excessive upward movement of the shelf members 30 in relation to the end sections 14. That is, during transport, the tab-like members 44 prevent dislodgment of the shelves that may be caused, for example, by a truck's driving over rough roads.

The position and orientation of the attachment members 38 and tab-like members 44 are preferably such that, while the tab-like members 44 help to prevent excessive upward movement of the shelf member 30 in relation to the support members 18, enough vertical space between the attachment members 38 and the tab-like member 44 is provided to enable the shelf members 30 to be lifted from the support members 18 and removed when desired. This is particularly important to enable each shelf member 30 to be moved from the horizontal position to the tilted position as discussed previously. To ensure that the tab-like members 44 lock the shelves during transit by preventing excessive upward movement of the shelf members 30 and, at the same time, do not prevent the adjustment of the shelf members 30, the attachment members 38 and tab-like members 44 are preferably oriented in relation to the support members 18 as shown in FIG. 10, i.e., sufficient vertical space exists between the downwardly extended portions 42 of the attachment members 38 and the upper surface of the tab-like members 44. The tab-like members 44 also preferably do not extend outward in relation to the wall of the shelf member 30 beyond the distance of the attachment members 38.

In use, each of the shelf members 30 can be placed on and between two opposing support members 18 on opposing end sections 14. By placing each shelf member 30 on opposing support members located at the same level, each of the shelf members 30 can be positioned horizontally, and the vertical spacing between the shelf members 30 can be easily adjusted, which is particularly useful to adapt to different sized plants and flowers. To tilt a shelf member 30, the front edge 36 of the shelf member 30 can be lifted and pulled outward or forward until the front attachment members 39 are lifted off of and over the front inwardly oriented portions 28 of the support members 18. Once the front attachment members 39 are pulled far enough over the inwardly oriented portions 28 or end caps 53, the front of the shelf member 30 can be dropped down to the adjacent level of support members 18 below. The shelf member 30 can then be pushed back in until the downwardly extended portions 42 of the front attachment members 39 are positioned inside the front inwardly oriented portions 28 or end caps 53 of the lower support members 18. By placing the front attachment members 39 inside the inwardly oriented portions 28 or end caps 53 of the support members 18, the downwardly extended portions 42 prevent the shelf member 30 from sliding off of the support members 18. Because the back attachment members 37 remain positioned on the upper support members 18, and the front attachment members 39 are positioned on the lower support members 18, the shelf member 30 is tilted. When two shelf members 30 of equal size are positioned side-by-side, the shelf members 30 can be tilted so that they face in opposite directions, as shown in FIG. 6, maximizing access and visibility to the shelf members from both sides of the device during display.

To stack the frames, one frame can be lifted and positioned on top of another frame, placing the footings 40 of the top frame onto the support posts 16 of the lower frame. The frames can be stacked in this manner with the shelf members 30 fully loaded using forklift tines that can be inserted into the brackets 12 to lift the frames if desired. The end sections 14 can also easily be separated from the base units 2 by pulling the support posts 16 from the connecting rods 20 or tube-like members 19, as the case may be, onto which they are secured, until the end sections are separated from the base unit. The base units 2 can then be stacked on top of each other, placing the footings 40 of one base unit 2 onto the connecting rods 20 or tube-like members 19 of the adjacent lower base unit 2.

The present invention enables the shelf members to be used for a number of purposes. For example, the shelf members can be used as growing trays. The pots with seeds can be placed on shelf members in a green house or the like and used to grow the plants and flowers. Once the plants and flowers are grown and ready to ship, the shelf members can be removed and set on the support frames. From that point forward, the present invention enables the pots to remain on the shelf members without having to remove them again during shipment and delivery.

A dolly comprising a frame of its own with wheels below each corner can also be provided to enable the frame or frames to be transported. The dolly preferably has a plate adapted to extend below each of the end sections 14 to provide support to the two footings 40 on each end, and one or more support braces extending in the long direction connecting the plates together. The dolly is preferably sized to match the size of the frame so that it does not take up any more space than the frame, and so that it does not represent a tripping hazard for customers. The wheels are also directly below the plates so that they are kept out of the way. The dolly preferably is sized to enable various types of racks or frames to be supported so that one dolly can be used to move a number of racks and frames.

The present invention also contemplates that the frame can be used to support other types of display racks, including the rack shown in my previous U.S. Pat. No. 5,233,931, wherein the sizing of the adjacent frames are made compatible. In this manner, the frame as well as the dolly can be used universally with other types of similar products. To the extent any subject matter discussed above does not include the subject matter contained in U.S. application Ser. No. 08/608,083, that application is incorporated herein by reference.

What is claimed is:

1. A device for displaying merchandise and the like, comprising:

a base unit having a first portion and a second portion;

two support posts extending substantially upwardly from each of said first and second portions of said base unit, said two support posts extending from said first portion forming a first support frame, and said two support posts extending from said second portion forming a second support frame, wherein said support frames are opposed to one another in a lateral direction;

multiple elongated support members extending substantially between said two support posts on each of said support frames, wherein said support members extend substantially in a longitudinal direction that is transverse to said lateral direction, wherein each of said support members has two inwardly oriented portions adjacent said two support posts, and an elongated portion extending in a longitudinal direction between said inwardly oriented portions;

two shelf members each having a first end and a second end, wherein first and second attachment members extend outwardly from each of said first and second ends, and wherein said shelf members can be extended between and supported by said support frames, and are adapted such that they can be positioned side-by-side and tilted in opposite directions in said longitudinal direction, by placing said first attachment members of said shelf members onto support members located at a first level, and said second attachment members of said shelf members onto support members located at a second level.

2. The device of claim 1, wherein said elongated support members are bars or angle irons that are substantially parallel to one another and extend substantially horizontally between said support posts on each of said support frames.

3. The device of claim 1, wherein each of said shelf members has at least one retainer wall extending along a front lateral edge, such that when said shelf members are tilted at an angle in said longitudinal direction, objects resting on said shelf members are retained thereon.

4. The device of claim 1, wherein one or more tabs are extended from each of said first and second ends of said shelf members, wherein said first and second attachment members extend from a vertically high portion of said first and second ends, and said one or more tabs extend from a vertically low portion of said first and second ends, wherein said one or more tabs limit the upward movement of said shelf members in relation to said support members.

5. The device of claim 1, wherein said support frames are removably secured to said base unit.

6. The device of claim 5, wherein said base unit has a pair of connecting elements extending upwardly therefrom on each of said first and second portions, wherein each of said connecting elements is adapted to engage and removably support one of said support posts of said support frames.

7. The device of claim 6, wherein said connecting elements comprise rods that extend upwardly from said base unit, wherein each rod is adapted to enable a support post to be removably mounted thereon.

8. The device of claim 6, wherein said connecting elements comprise tube-like members that extend upwardly from said base unit, wherein each tube-like member is adapted to enable a support post to be removably mounted thereon.

9. The device of claim 6, wherein said base unit has foot members for supporting said base unit in relation to the ground, wherein said foot members are also adapted to mate with the upper ends of said support posts, wherein two or more substantially identical devices can be stacked on top of each other, by placing foot members of one device onto support posts of another adjacent device.

10. The device of claim 6, wherein said base unit has foot members for supporting said base unit in relation to the ground, wherein said foot members are also adapted to mate with the connecting elements, wherein two or more substantially identical base units can be stacked on top of each other by removing said support frames from each of said base units, and placing said foot members onto connecting elements of another adjacent base unit.

11. The device of claim 1, wherein said first level is lower than said second level, and said shelf members are prevented from sliding off of said support members by the engagement of said first attachment members of said shelf members with the inwardly oriented portions of the support members on which said first attachment members rest.

* * * * *